United States Patent [19]

Hasegawa

[11] Patent Number: 4,687,140

[45] Date of Patent: Aug. 18, 1987

[54] SPRAYING APPARATUS

[75] Inventor: Kyohei Hasegawa, Nagaoka, Japan

[73] Assignee: Nippon Seiki Co., Ltd., Nigata, Japan

[21] Appl. No.: 785,605

[22] Filed: Oct. 8, 1985

[30] Foreign Application Priority Data

Jul. 30, 1985 [JP] Japan ..... 60-168130

[51] Int. Cl.[4] ..... B05B 9/04

[52] U.S. Cl. ..... 239/332; 74/828

[58] Field of Search ..... 239/332; 417/416, 417; 92/13.8; 222/333; 74/104, 526, 828

[56] References Cited

U.S. PATENT DOCUMENTS

| | | | |
|---|---|---|---|
| 2,494,837 | 1/1950 | Simmons . | |
| 2,999,646 | 9/1961 | Wagner | 239/332 |
| 3,120,347 | 2/1964 | Duke, Jr. | 239/332 |
| 3,445,068 | 5/1969 | Wagner . | |
| 4,160,525 | 7/1979 | Wagner | 239/332 |
| 4,442,977 | 4/1984 | Beiswenger et al. | 239/332 |

FOREIGN PATENT DOCUMENTS

| | | | |
|---|---|---|---|
| 2044895 | 10/1980 | United Kingdom | 74/828 |

*Primary Examiner*—Andres Kashnikow
*Assistant Examiner*—Daniel R. Edelbrock
*Attorney, Agent, or Firm*—Lowe Price LeBlanc Becker & Shur

[57] ABSTRACT

The spraying condition adjusting mechanism of a spraying apparatus according to the present invention has a regulating member fitted on the spraying condition adjusting member so as to turn together with the spraying condition adjusting member, and stoppers are formed in the main housing of the spraying apparatus and the regulating member, respectively, to limit the turning of the spraying condition adjusting member, so that spraying apparatus can be adjusted simply to a desired spraying condition by turning the spraying condition adjusting member within a limited range defined by the stoppers.

6 Claims, 10 Drawing Figures

35
34
53
57
52A
52B
58
59
60
52
56
55
61

255
256
257
231

SPRAYING APPARATUS

BACKGROUND OF THE INVENTION

1. Field of the Invention

The present invention relates to a spraying apparatus for spraying a liquid such as water or paint and, more specifically, to improvements in an adjusting mechanism for adjusting the spraying condition of a spraying apparatus.

2. Description of the Prior Art

Simple spraying apparatus are disclosed, for example, in U.S. Pat. Nos. 2,494,837 and 3,445,068. Such a well-known spraying apparatus is shown in FIG. 10. Referring to FIG. 10, indicated at 1 is a main housing fixedly holding a solenoid 2 incorporating an armature 3. A grip 4 provided with a switch unit 5 is extended downward from the main housing 1. An AC voltage is applied to the solenoid 2 by operating the switch unit 5 to vibrate the armature 3 laterally. A pump housing 1A is fixed to the front side of the main housing 1 with a fixing screw 6. A cylinder 7 is disposed within the pump housing 1A so as to extend laterally. A piston 8 is fitted into the cylinder 7 and a compression spring 9 is interposed between the piston 8 and the cylinder 7. The piston 8 is reciprocated within the cylinder 7 by the positive action of the armature 3 caused by energizing the solenoid 2 and resilient action of the compression spring 9. A cap 10 is formed integrally with the pump housing 1A at the lower side of the same. A vessel 11 for containing a liquid such as water or paint is screwed on the threaded portion 12 of the cap 10. Suction holes 13 and discharge holes 14 are formed in the pump housing 1A and the cap 10. The upper end of a suction pipe 15 is fitted into the suction hole 13 of the cap 10. A strainer 16 is attached to the lower end of the suction pipe 15 so as to enclose the inlet of the suction pipe 15. A nozzle holder 17 is screwed on the front end of the pump housing 1A so as to hold a valve 18, a compression spring 19 and a nozzle 20 in place within the front end of the pump housing 1A. A housing cover 1B is fixed to the main housing 1 with screws 21 to cover the solenoid 2 and the armature 3. An adjusting member 22 is screwed through a compression spring 23 on the main housing 1. The amplitude of vibration of the armature 3 is adjustable by means of the adjusting member 22.

The amplitude of vibration of the armature is decided by adjusting the distance between the front end face 22A of the adjusting member 22 and the rear end face of a stopper 24 provided on the main housing 1 to stop the armature 3 when the same is attracted by the magnetic action of the solenoid 2. The stroke of the piston 8 is adjusted by varying the distance to regulate the condition of the mist of the liquid sprayed through the nozzle 20. Accordingly, when the solenoid 2 is energized, the armature 3 vibrates between the adjusting member 22 and the stopper 24, and thereby the piston 8 is reciprocated within the cylinder 7 by the positive action of the armature 3 and the resilient action of the compression spring 9. The liquid, such as water or paint, contained in the vessel 11 is sucked through the suction pipe 15 into the cylinder 7 by the suction stroke of the piston 8, and then the liquid is compressed within the cylinder 7, the valve 18 provided at the opening of the cylinder 7 is opened against the resilient force of the compression spring 19 so that the liquid is allowed to flow into the front end of the cylinder 7 through the gap between the opening of the cylinder 7 and the valve 18 and the liquid is sprayed through the nozzle hole of the nozzle 20 by the compression stroke of the piston 8.

Thus in the conventional spraying apparatus, the condition of the mist to be sprayed through the nozzle 20 is regulated by adjusting the amplitude of vibration of the armature 3 by turning the adjusting member 22, however, this spraying apparatus does not have any standard for adjusting the spraying condition, and hence the adjusting member 22 is apt to be turned excessively, and thereby the amplitude of vibration of the armature is enhanced excessively and the solenoid 2 is often overloaded.

SUMMARY OF THE INVENTION

Accordingly, it is an object of the present invention to eliminate the above-mentioned disadvantages of the conventional spraying apparatus and to provide a spraying apparatus capable of appropriately setting the amplitude of vibration for desired spraying condition.

The above and other objects, features and advantages of the present invention will become more apparent from the following description of the preferred embodiments thereof taken in conjunction with the accomapnying drawings.

DESCRIPTION OF THE PREFERRED EMBODIMENTS

Preferred embodiments of the present invention will be described hereinafter in conjunction with the accompanying drawings.

Figure 1:
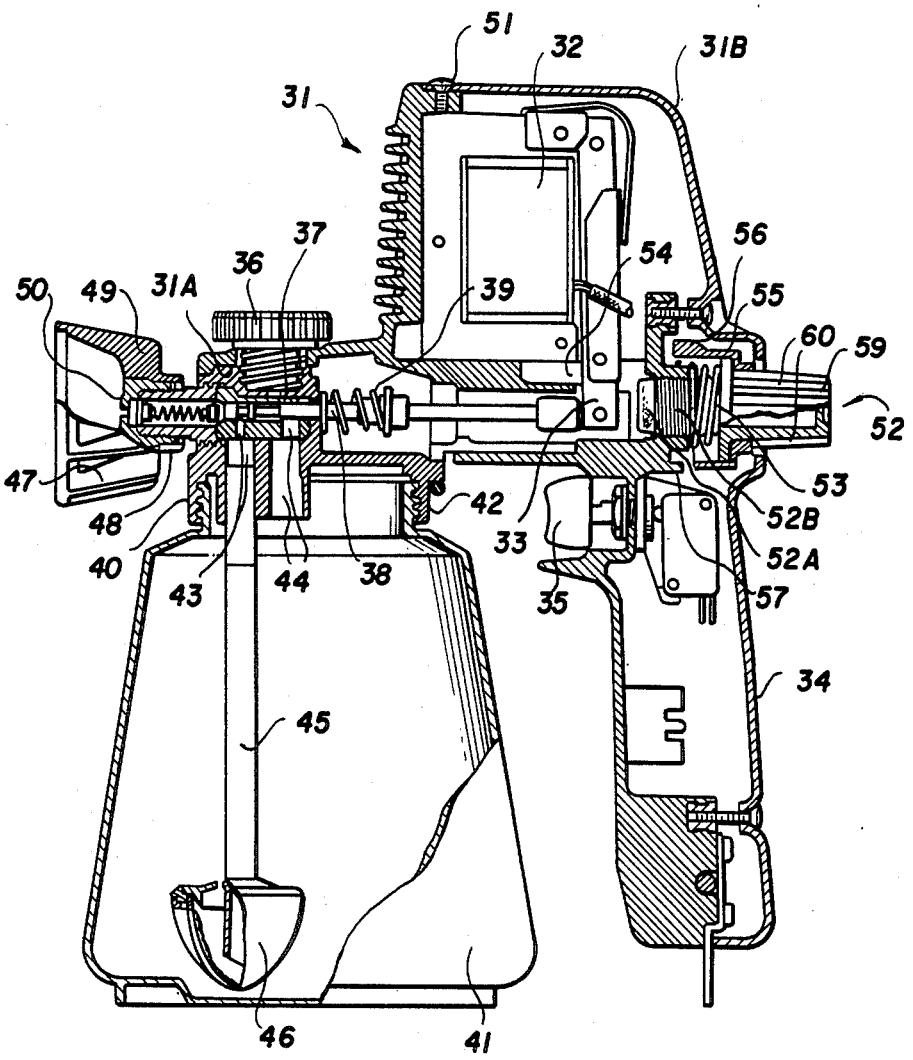
FIG. 1 is a general sectional view of a spraying apparatus according to the present invention.

Referring to FIG. 1, a solenoid 32 incorporating an armature 33 is held fixedly on a main housing 31 of a spraying apparatus. A grip 34 is formed integrally with the main housing 31 so as to extend downward from the main housing 31 and is provided with a switch unit 35. An AC voltage is applied to the solenoid 32 by operating the switch unit 35 to vibrate the armature 33 laterally. A pump housing 31A is fixed to the front side of the main housing 31 with screws 36. A cylinder 37 is extended laterally within the pump housing 31A. A piston 38 is fitted through the rear end of the cylinder 37 into the cylinder 37 and a compression spring 39 is interposed between the cylinder 37 and the piston 38.

When the solenoid 32 is energized, the piston 38 is reciprocated within the cylinder 37 by the positive action of the armature 33 and the resilient action of the compression spring 39.

A cap 40 having a threaded portion 42 is formed integrally with the pump housing 31A. A vessel 41 for containing a liquid, such as water or paint, is screwed on the threaded portion 42. Suction holes 43 and discharge holes 44 are formed in the pump housing 31A and the cap 40. The upper end of a suction pipe 45 is fitted into the suction hole 43 formed in the cap 40. The suction inlet 43 of the suction pipe 45 is enclosed by a strainer 46.

A nozzle holder 47 is screwed on the front end of the pump housing 31A to hold a valve 48, a compression spring 49 and a nozzle 50 within the front end of the pump housing 31A.

A housing cover 31B is fixed to the main housing 31 with screws 51 to cover the solenoid 32 and the armature 33. An adjusting member 52 is screwed through a compression spring 53 into the main housing 31. The amplitude of vibration of the armature 33 is adjusted by adjusting the depth of engagement of the threaded portion 52B of the adjusting member 52. The amplitude of vibration of the armature 33 is dependent on the distance between the front end 52A of the adjusting member 52 and a stopper 54, such as a rubber member, provided on the main housing 31 to stop the armature 33 when the same is attracted by the magnetic action of the solenoid 32. The distance is varied to set the amplitude of vibration of the armature 33, hence, the stroke of the piston 38, the regulate the condition of the mist of the liquid sprayed through the nozzle 50.

In screwing the threaded portion 52B of the adjusting member 52 into the main housing 31, the compression spring 53 is interposed in a stressed state between the main housing 31 and the adjusting member 52 to prevent the idle turning of the adjusting member 52.

A regulating member 55 is fitted on the adjusting member 52 from the rear end of the same. Projections 56 and 57 are formed in the regulating member 55 and the main housing 31, respectively, to limit the turning motion of the adjusting member 52.

When the solenoid 32 is energized, the armature 33 vibrates between the front end portion 52A of the adjusting member 52 and the stopper 54 and the piston 38 is reciprocated within the cylinder 37 by the action of the armature 33 and the resilient action of the compression spring 39 for the suction stroke and the compression stroke. Then, the liquid, such as water or paint, contained in the vessel 41 is sucked through the suction pipe 45 into the cylinder 37. During the compression stroke of the piston 38, the valve 48 is moved against the resilient force of the compression spring 49, so that the liquid, such as water or paint, flows through the gap between the valve 48 and the outlet of the cylinder 37 and is sprayed through the nozzle hole of the nozzle 50.

As illustrated in FIGS. 2 to 5, in the spraying condition adjusting mechanism of the first embodiment, the adjusting member 52 has a flange 58 which receives one end of the compression spring 53 for preventing the idle turning of the adjusting member 52 and a knob 59 for operating the adjusting member 52. A plurality of longitudinal grooves 60, which also ensure firm grasp on the knob 59, are formed at equal intervals in the outer circumference of the knob 59. The regulating member 55 is formed so as to receive the flange 58 of the adjusting member 52. Protrusions 61 which engage the grooves 60 are formed in the inner circumference of the rear end of the regulating member 55. The projection 56 is formed in the front end of the regulating member 55 and the projection 57 is formed in the main housing 31 so as to project into the circular path of the projection 56.

When the regulating member 55 is fitted on the adjusting member 52, the protrusions 61 engages the grooves 60, and thereby the regulating member 55 is able to turn together with the adjusting member 52. The threaded portion 52B of the adjusting member 52 is screwed into the main housing 31. When the adjusting member 52 is turned, the regulating member 55 turns together with the adjusting member 52. In this embodiment, the projection 56 of the regulating member 55 comes into contact with the projection 57 of the main housing 31 when the adjusting member 52 is turned practically through one full turn, so that the turning of the adjusting member 52 is restricted within a desired range. The adjusting member 52 is screwed into the main housing 31 so that an appropriate range of amplitude of vibration of the armature 33 is established, and the regulating member 55 is then fitted on the adjusting member 52 so as to restrict the turning movement of the adjusting member 52 within a predetermined range. Thus the spraying condition adjusting mechanism can thereafter be simply adjusted so as to establish a desired spraying condition within the predetermined range.

Figure 6:
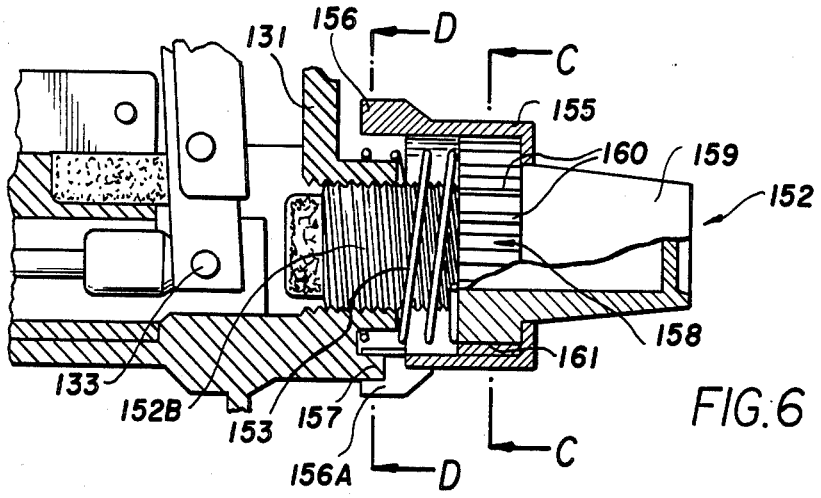
FIG. 6 is a sectional view of an essential portion of a spraying condition adjusting mechanism, in a second embodiment, according to the present invention.
Figure 7:
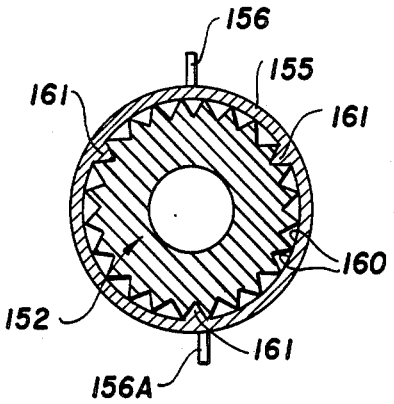
FIG. 7 is an enlarged sectional view taken along line C—C of FIG. 6.
Figure 8:
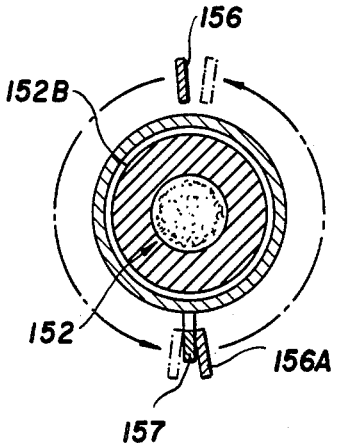
FIG. 8 is an enlarged sectional view taken along line D—D of FIG. 6.
Figure 10:
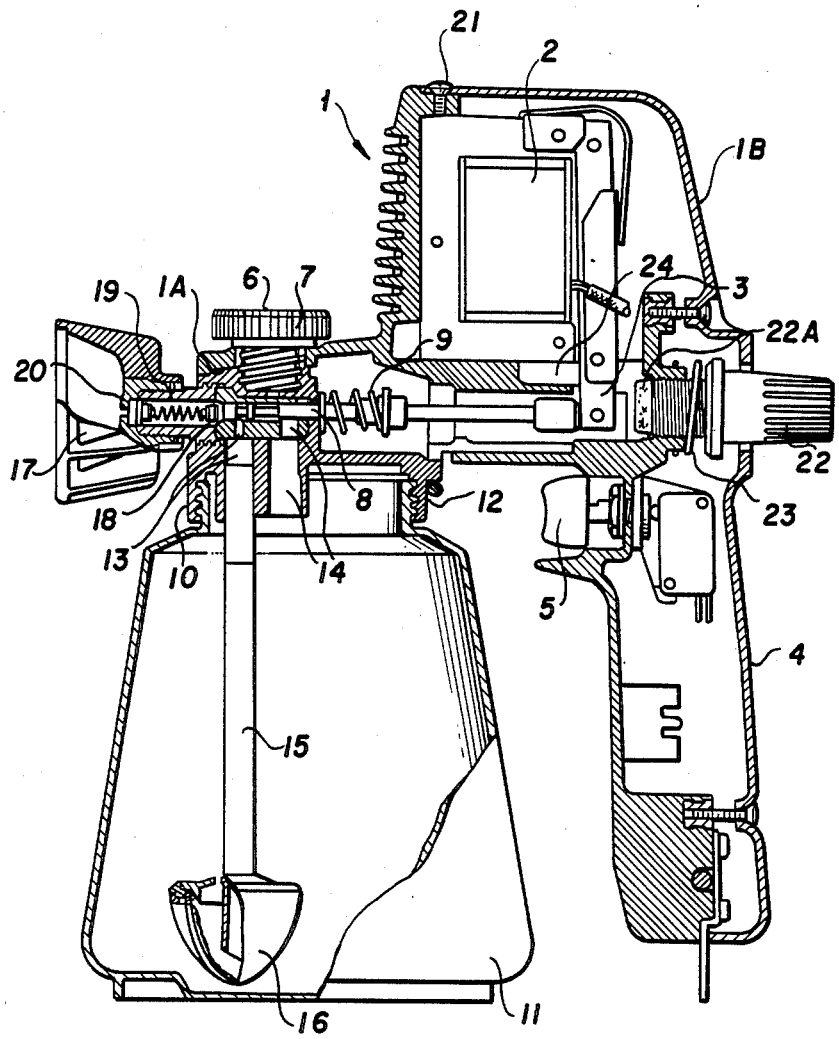
FIG. 10 (PRIOR ART)
FIG. 10 is a general sectional view of a conventional spraying apparatus.

FIGS. 6 to 8 illustrate a spraying condition adjusting mechanism, in a second embodiment, according to the present invention. In this embodiment, an adjusting member 152 consists of a threaded portion 152B, a flange 158 of a form capable of receiving one end of a compression spring 153 for preventing the idle turning of the adjusting member 152, and a knob 159. A plurality of grooves each having a triangular cross section are formed longitudinally at equal intervals on the outer circumference of the flange 158. Protrusions 161 capable of engaging the grooves 160 are formed in the inner circumference of a regulating member 155. A plurality of projections 156 and 156A are formed in the front end of the regulating member 155. A projection 157 is formed in a main housing 131 so as to project into the circular path of the projections 156 and 156A.

Figures 2, 9:
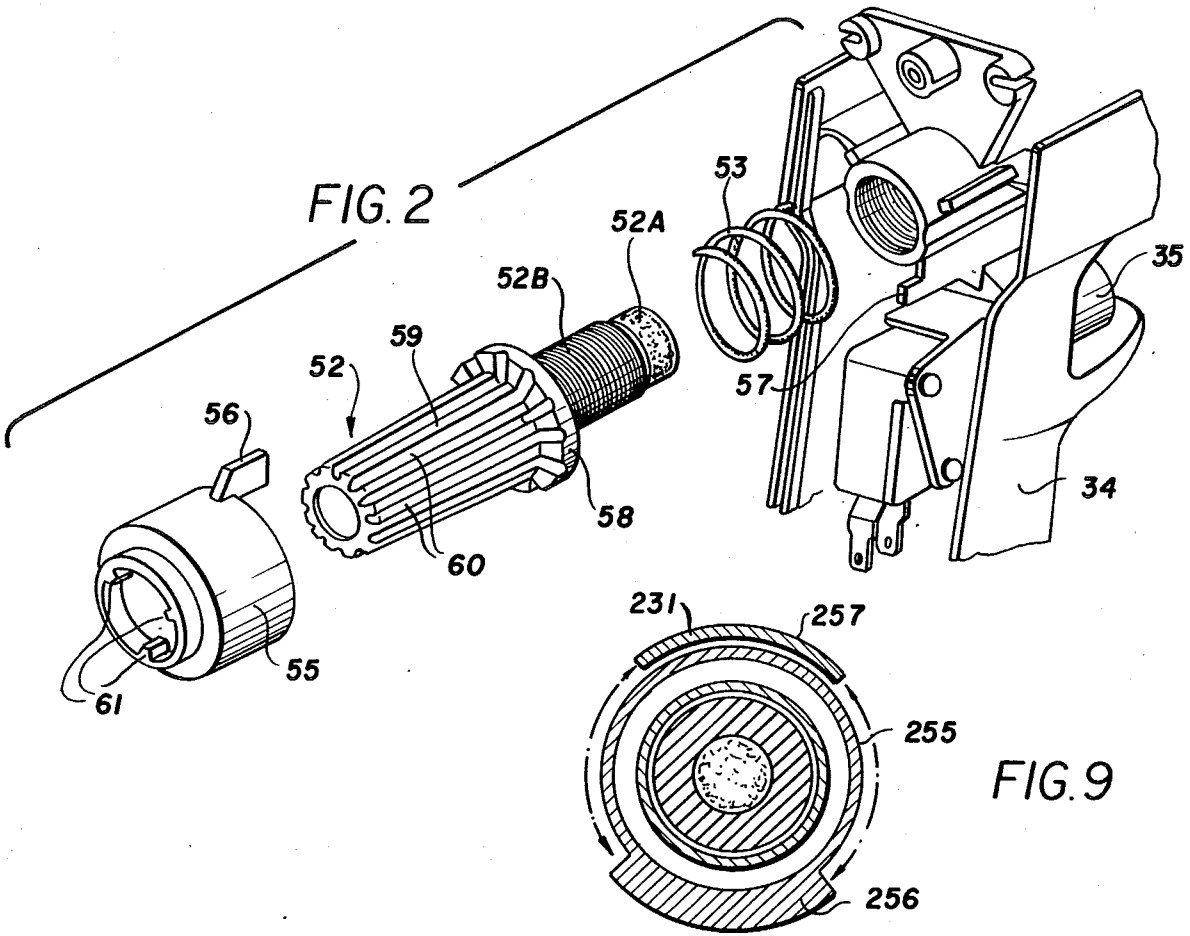
FIG. 2 is an enlarged perspective view of a spraying condition adjusting mechanism, in a first embodiment, according to the present invention.
FIG. 9 is a sectional view of a part of a spraying condition adjusting mechanism, in a third embodiment, according to the present invention.
Figure 3:
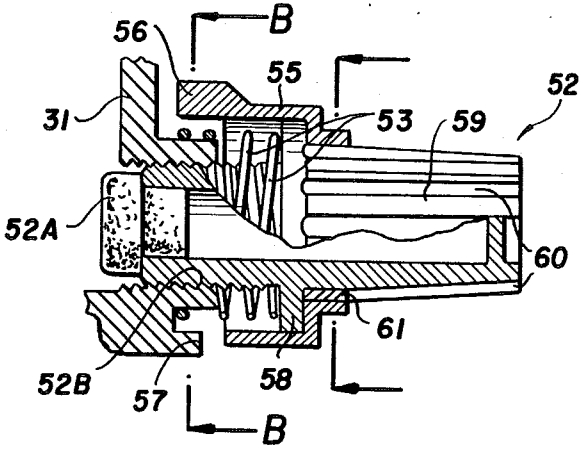
FIG. 3 is a sectional view of an essential portion of the spraying condition adjusting mechanism of FIG. 2.
Figure 5:
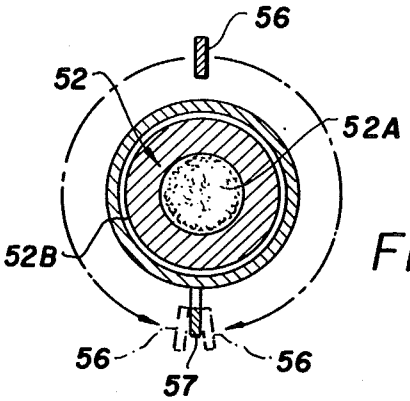
FIG. 5 is an enlarged sectional view taken along line B—B of FIG. 2.
Figure 4:
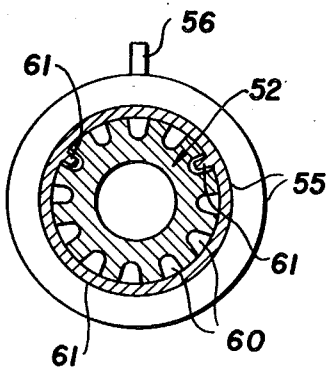
FIG. 4 is an enlarged sectional view taken along line A—A of FIG. 2.

After screwing the adjusting member 152 on the main housing 131 so that the amplitude of vibration of the armature 133 is appropriate, the regulating member 155 is fitted on the adjusting member 152 with the protrusions 161 engaging the grooves 160. Thus the turning of the adjusting member 152 is restricted to an extent where at least either the projection 156 or 156A of the regulating member 155 is in contact with the projection 157 of the main housing 131. Since the regulating member 152 is provided with two projections, namely, the projections 156 and 156A, the turning of the adjusting member 152 is limited to approximately half a turn in opposite directions. Although the projections 156 and 156A are formed in the regulating member 155 of the second embodiment as means to limit the turning of the adjusting member 152, the means to limit the turning of the adjusting member is not necessarily limited to such projections. In a third embodiment of the present invention, as shown in FIG. 9, a protrusion 256 extending along the circumference of a regulating member 255 and a protrusion 257 extending on the circular path of the protrusion 255 are formed in the regulating member 255 and a main housing 231 so that the protrusion 256 comes in contact with the protrusion 257 to limit the turning of an adjusting member. In the embodiments described hereinbefore, the housing cover is fixed to the main housing after fitting the regulating member on the adjusting member, however, the housing cover may be fixed to the main housing before fitting the regulating member on the adjusting member.

What is claimed is:

1. A spraying apparatus comprising:

a main body;

a solenoid held in the main body;

an armature associated with the solenoid so as to be vibrated when the solenoid is energized;

a spraying mechanism including a cylinder, a piston fitted into the cylinder and a nozzle;

a mechanism for reciprocating the piston within the cylinder by the agency of the vibration of the armature to suck a liquid into the cylinder and to spray the sucked liquid through the nozzle;

an adjusting member screwed into the main body so that the depth of engagement thereof with the main body is variable so that the amplitude of vibration of the armature is adjusted by varying the depth of engagement of the adjusting member with the main body; and a regulating member with a generally cylindrical aperture that fits around the adjusting member in any of several angularly spaced relative positions with respect thereto and makes said regulating member rotatable therewith in a predetermined angular juxtaposition about a common rotational axis, with a projection formed on the regulating member and a projection formed in the main body, said regulating member projection coacting solely with said main body projection to define the range of turning of the adjusting member and thus define predetermined limits of turning of the adjusting member in both directions, whereby corresponding maximum and minimum amplitudes of said armature vibration, and hence the flow rates of liquid spray corresponding to said maximum and minimum amplitudes, are determined.

2. A spraying apparatus according to claim 1, wherein longitudinal grooves are formed in the outer circumference of the adjusting member, and at least one corresponding protrusion is formed at the inner circumference of the regulating member so as to be engageable with the longitudinal grooves of the adjusting member in any of said plurality of said angularly spaced relative positions.

3. A spraying apparatus according to claim 2 wherein said adjusting member has a user-contactable portion for operating of the adjusting member, and user-contactable portion having an externally grooved surface to facilitate firm grasping thereof by a user.

4. A spryaing apparatus according to claim 1, wherein:

an elastic member is interposed between said main body and said adjusting member to prevent the idle turning of said adjusting member.

5. A spraying apparatus according to claim 1, wherein:

an elastic member is interposed between said main body and said adjusting member to prevent the idle turning of said adjusting member;

said adjusting member has a flange which rceives one end of said elastic member and also has a user-contactable portion for turning of said adjusting member for adjustment of the depth of engagement of the adjusting member with said main body, with longitudinal grooves formed in the outer circumference of said flange; and at least one protrusion is formed at said aperture of said regulating member so as to be engageable with said longitudinal grooves of the flange in any of a plurality of said angularly spaced relative positions.

6. A spraying apparatus according to claim 1, wherein:

said projection on said regulating member is formed so that coaction thereof with said projection on said main body limits the turning of the adjusting member to appoximately one turn.

* * * * *